US006783423B2

(12) United States Patent
Kaneko et al.

(10) Patent No.: US 6,783,423 B2
(45) Date of Patent: Aug. 31, 2004

(54) ATTACHMENT STRUCTURE FOR MOTOR FOR TOY, TOY WITH THE ATTACHMENT STRUCTURE FOR MOTOR AND RACING VEHICLE TOY

(75) Inventors: Yoshinobu Kaneko, Tokyo (JP); Yousuke Yoneda, Tokyo (JP); Yoshio Suimon, Tokyo (JP)

(73) Assignee: TOMY Company, Ltd., Tokyo (JP)

( * ) Notice: Subject to any disclaimer, the term of this patent is extended or adjusted under 35 U.S.C. 154(b) by 269 days.

(21) Appl. No.: 10/056,073

(22) Filed: Jan. 28, 2002

(65) Prior Publication Data

US 2003/0143919 A1 Jul. 31, 2003

(51) Int. Cl.[7] ..... A63H 17/00
(52) U.S. Cl. ..... 446/269; 446/457
(58) Field of Search ..... 446/457, 461, 446/470, 90, 269, 456, 463, 462; 180/65.1; 310/64, 91

(56) References Cited

U.S. PATENT DOCUMENTS

| | | | | | |
|---|---|---|---|---|---|
| 3,041,485 | A | | 6/1962 | Jolley | |
| 3,293,462 | A | | 12/1966 | Wright | |
| 3,622,822 | A | * | 11/1971 | Lofstrand | 310/89 |
| 3,628,284 | A | | 12/1971 | Soulakis et al. | 46/243 LV |
| 3,634,969 | A | * | 1/1972 | Harlting et al. | 446/463 |
| 3,733,744 | A | | 5/1973 | Hiltpold et al. | |
| 3,827,181 | A | | 8/1974 | Mabuchi | 46/243 AV |
| 3,959,921 | A | * | 6/1976 | Klint | 446/279 |
| 3,977,758 | A | * | 8/1976 | Mabuchi | 439/500 |
| 4,005,320 | A | | 1/1977 | Mabuchi et al. | |
| 4,028,571 | A | * | 6/1977 | Dicke | 310/89 |
| 4,073,086 | A | | 2/1978 | Ogawa | 46/91 |
| 4,183,173 | A | | 1/1980 | Ogawa | 46/202 |
| 4,406,085 | A | | 9/1983 | Rhodes | 46/254 |
| 4,511,343 | A | | 4/1985 | Goldfarb et al. | 446/463 |
| 4,764,150 | A | | 8/1988 | Uchino | 446/456 |
| 4,889,516 | A | | 12/1989 | Auer et al. | |
| 5,045,013 | A | | 9/1991 | Fujitani | |
| 5,343,102 | A | | 8/1994 | Mabuchi et al. | |
| 5,621,260 | A | | 4/1997 | Fukuoka et al. | |
| 5,762,533 | A | * | 6/1998 | Tilbor et al. | 446/466 |
| 5,835,006 | A | | 11/1998 | Michalak et al. | |
| 5,889,349 | A | | 3/1999 | Yasuda | |
| 5,986,367 | A | | 11/1999 | Tsuzaki et al. | |
| 6,074,271 | A | | 6/2000 | Derrah | 446/457 |
| 6,508,322 | B2 | * | 1/2003 | Dignitti et al. | 180/68.5 |
| 6,631,774 | B2 | * | 10/2003 | Hayashi | 180/65.1 |
| 2002/0094752 | A1 | | 7/2002 | Kaneko et al. | |
| 2003/0143921 | A1 | | 7/2003 | Yoneda | |

FOREIGN PATENT DOCUMENTS

| | | |
|---|---|---|
| GB | 1145812 | 4/1969 |
| GB | 1278362 | 6/1972 |
| GB | 1375723 | 11/1974 |
| GB | 2313427 | 11/1997 |
| JP | 10-084649 | 3/1998 |
| JP | 10-084650 | 3/1998 |
| JP | 11-98756 | 4/1999 |

OTHER PUBLICATIONS

English translation of Japanese Publication No. 10–084649, dated Mar. 31, 1998, already of record.
English translation of Japanese Publication No. 10–084650, dated Mar. 31, 1998, already of record.
IBM Tech. Discl. Bulletin, "Electrical Connection of a Motor Without the Use of Cables", vol. 30, No. 9, p. 138, Feb. 1998.

* cited by examiner

*Primary Examiner*—Jacob K. Ackun
*Assistant Examiner*—Jamila O Williams
(74) *Attorney, Agent, or Firm*—Staas & Halsey LLP

(57) ABSTRACT

An attachment structure for motor and a racing vehicle toy, wherein a motor can easily be inserted and removed therefrom, are provided. The attachment structure includes a motor holding plate capable of turning on a predetermined rotational shaft line attached to a chassis or base body. The motor holding plate includes an engaging portion capable of elastically engaging with an engage portion provided on the chassis when the motor holding plate is at the close position. The motor holding plate is capable of taking up an open position for opening the motor containing part and a close position for closing the motor containing part the turning. The motor holding plate holds the motor in the motor containing part in the close position.

29 Claims, 7 Drawing Sheets

ATTACHMENT STRUCTURE FOR MOTOR FOR TOY, TOY WITH THE ATTACHMENT STRUCTURE FOR MOTOR AND RACING VEHICLE TOY

BACKGROUND OF THE INVENTION

1. Field of the Invention

The present invention relates to an attachment structure for motor, especially to an attachment structure for a motor for a toy. The present invention relates to, for example, an attachment structure particularly usefully adapted to a motor which is frequently attached and detached. The present invention also relates to a toy with the attachment structure for a motor and a racing vehicle toy.

2. Description of Related Art

In general, motors serve as power sources in, for example, various toys. The power of the motor is transmitted to actuating parts (in a running toy, they are wheels, or in a robot toy or a doll toy, they are arms and legs) through gear mechanisms.

It is to be noted that when the motor is attached, it is indispensable to employ a structure where the motor does not move relative to a motor attachment portion. The reason is that when the motor moves, for example, the engagement between a motor gear and a gear which meshes thereto becomes incomplete, so that the transmission of the power to the actuating parts becomes insufficient.

Thus, when the motor is attached to the motor attachment portion, while the motor is held tightly by a motor holding plate, the motor is fixed by screwing of the motor holding plate.

With a motor carried in a racing vehicle toy or the like, there is a case that it is preferable to change the motor according to the particular race courses (for example, there are many curves or the like). However, with the toy where the motor holding plate is screwed, because the screw is required to be detached and attached during the exchange of the motor, it is a bother. With a motor to which a conductive wire is adhered, the conductive wire is required to be attached and detached with solder, so that it is much bother.

SUMMARY OF THE INVENTION

The present invention is attained in view of such problems. An object of the present invention is to provide an attachment structure for a motor and a toy, such as a racing vehicle toy or the like, wherein it is possible to easily attach a motor thereto and remove therefrom.

In accordance with the first aspect of the present invention, an attachment structure for a motor for a toy, for setting a motor in a motor containing part provided in a base body of a toy, comprises a motor holding plate capable of turning on a predetermined rotational shaft line attached to the base body. The motor holding plate is capable of taking up an open position for opening the motor containing part and a close position for closing the motor containing part by turning. The motor holding plate holds a body part of the motor set in the motor containing part at the close position. The motor holding plate comprises an engaging portion which is capable of engaging with an engage portion provided on the base body with elasticity of the engaging portion or the engage portion when the motor holding plate is disposed at the close position.

The "base body" means a portion forming the motor containing part and its vicinity. The base body may comprise only one member, or two or more members combined with each other. The "rotational shaft line" may extend in a direction parallel to or in a direction crossing (for example, intersecting at right angles) the shaft of the motor set in the motor containing part. Further, the "engage portion" may be a projection, an edge of a hole or the like. The point is that the engage portion may be any one such that the engaging piece can engage with the engage portion with elasticity of the engaging piece or the engage portion. The material of the "motor holding plate" may be metal or synthetic resin. The "attachment structure for motor for toy" may be applied to a vehicle toy, a robot toy, a doll toy or other toys. Although the type of the toy is not limited, the attachment structure is particularly useful when it is applied to a toy of which motor is often exchanged for other ones. The "opening the motor containing part" does not mean complete opening of the motor containing part, but includes an opening such that the motor can be attached to and removed from the motor containing part. The "closing the motor containing part" does not need to close the whole motor containing part, and includes such a closing as will obstruct the attachment and removal of the motor.

According to the attachment structure for a motor, the motor can be set in the motor containing part by turning the motor holding plate to the open position. Thereafter the motor holding plate is turned to the close position, and the engaging piece is elastically engaged with the engage portion of the base body. Thus the motor can be fixed. On the other hand, when the force is applied to the engaging piece which is elastically engaged with the engage portion of the base body, the engagement is released. Thereafter, the motor holding plate is turned to the open position, so that the motor can be removed from the motor containing part.

With the attachment structure for a motor, it is preferable that the rotational shaft line is parallel to a shaft of the motor set in the motor containing part, and the engage portion is provided on an opposite side of the motor containing part with respect to the rotational shaft line.

According to the attachment structure for a motor, the rotational shaft line of the motor holding plate extends in parallel with the shaft of the motor, so that the periphery of the body part is approximately uniformly held by the motor holding plate. Furthermore, the engage portion is provided on the position which is the opposite side of the motor containing part with respect to the rotational shaft line, so that the motor holding plate holds surely the motor.

It is preferable that the motor holding plate serves as a radiation plate. In order to apply the motor holding plate to the radiation plate, the "motor holding plate" is required to be made of material which has high radiation effect. For that purpose, it is preferable that the "motor holding plate" is made of metal, such as copper or aluminum. However, the motor holding plate may be made of synthetic resin or the like (for example, ABS resin) if it has a form with high radiation effect.

According to the attachment structure, the motor holding plate serves as the radiation plate, so that there is no need to set extra radiation plate and radiation mechanism in the attachment structure.

With the attachment structure for a motor for a toy, the motor may be a DC motor where terminals are provided on a rear side and a body part, the motor containing part may be provided with conductive pieces which may be electrically connected to each of the terminals of the motor, and when the motor is fitted in the motor containing part, the corresponding conductive piece may be electrically connected to each of the terminals.

According to the structure, the conductive pieces which are electrically connected to respective terminals of the motor are set in the motor containing part, so that each terminal of the motor, when the motor is fitted in the motor containing part, is electrically connected to each conductive piece immediately.

The motor may be a DC motor where terminals are provided on a rear side and a body part, and the motor containing part may be provided with a conductive piece which is electrically connected to the terminal on the rear side of the motor. The motor holding plate may be made of conductive material so as to be electrically connected to the terminal on the body part of the motor. The conductive piece may be electrically connected to the terminal on the rear side of the motor when the motor is fitted in the motor containing part. Further, when the motor holding plate is moved to the close position while the motor is set in the motor containing part, the motor holding plate may be electrically connected to the terminal on the body part of the motor.

According to the attachment structure for motor, the conductive piece which is electrically connected to the terminal on the rear side of the motor may be set in the motor containing part, so that the terminal on the rear side of the motor, when the motor is fitted in the motor containing part, may be electrically connected to the conductive piece immediately. Further, when the motor holding plate is moved to the close position while the motor is set in the motor containing part, the motor holding plate may be electrically connected to the terminal on the body part of the motor immediately.

According to the second aspect of the present invention, a toy comprises a base body provided with a battery containing part for containing a battery and a motor containing part for containing a cylindrical motor;

the cylindrical motor contained in the motor containing part; and a motor holding member capable of turning on a shaft approximately parallel to a rotational shaft of the cylindrical motor, the motor holding member capable of taking up an open position for opening the motor containing part and a close position for closing the motor containing part by the turn, and the motor holding member comprising an engaging portion which is capable of elastically engaging with an engage portion provided on the base body while the engaging portion holds an exposed peripheral portion of the motor set in the motor containing part at the close position.

Preferably, the motor containing part of the base body is provided with a first electrode piece connected to one electrode of the battery at one position with which a peripheral body part of the motor is brought into contact, and a second electrode piece connected to another electrode of the battery at a different position which is insulated to the one position. The motor may be a DC motor, and at least a portion of the peripheral body part may serve as one of positive and negative terminals of the motor.

It is preferable that a rear side of the motor is provided with the other of the positive and negative terminals of the motor, and the motor can be contained in the motor containing part such that the peripheral body part is connected to the first electrode piece while the rear side is connected to the second electrode piece.

According to the toy with the above structure, by turning the motor holding plate to the close position and by elastically engaging the engaging piece with the engage portion of the base body, the motor can be fixed, and at the same time, the positive and negative terminals of the motor can be electrically connected to the pair of electrode pieces.

According to the third aspect of the present invention, a racing vehicle (racing car) toy comprises an attachment structure for a motor for a toy. The attachment structure comprises a motor holding plate capable of turning on a predetermined rotational shaft line attached to the base body. The motor holding plate is capable of taking up an open position for opening the motor containing part and a close position for closing the motor containing part by turning. The motor holding plate holds a body part of the motor set in the motor containing part at the close position. The motor holding plate comprises an engaging portion which, when the motor holding plate is disposed at the close position, is capable of engaging with an engage portion provided on the base body with elasticity of the engaging portion or the engage portion.

According to the racing vehicle toy, the user has only to turn the motor holding plate for exchanging the motor according to the racing course.

DESCRIPTION OF THE EMBODIMENTS

Figure 1:
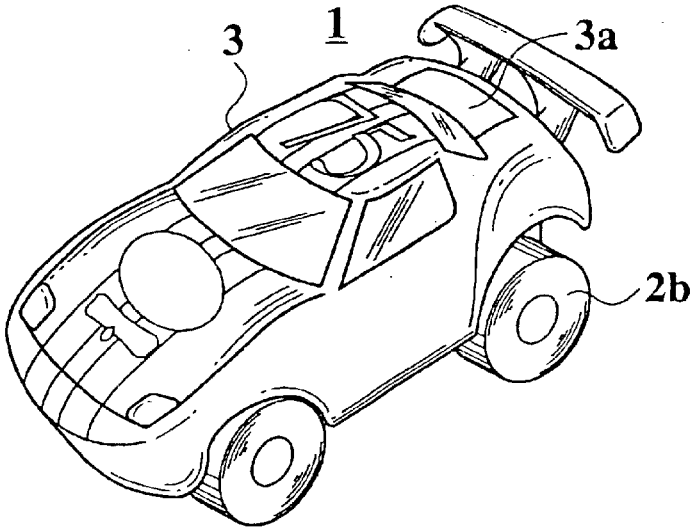
FIG. 1 is a perspective view of a racing vehicle toy according to an embodiment of the present invention.
Figure 2:
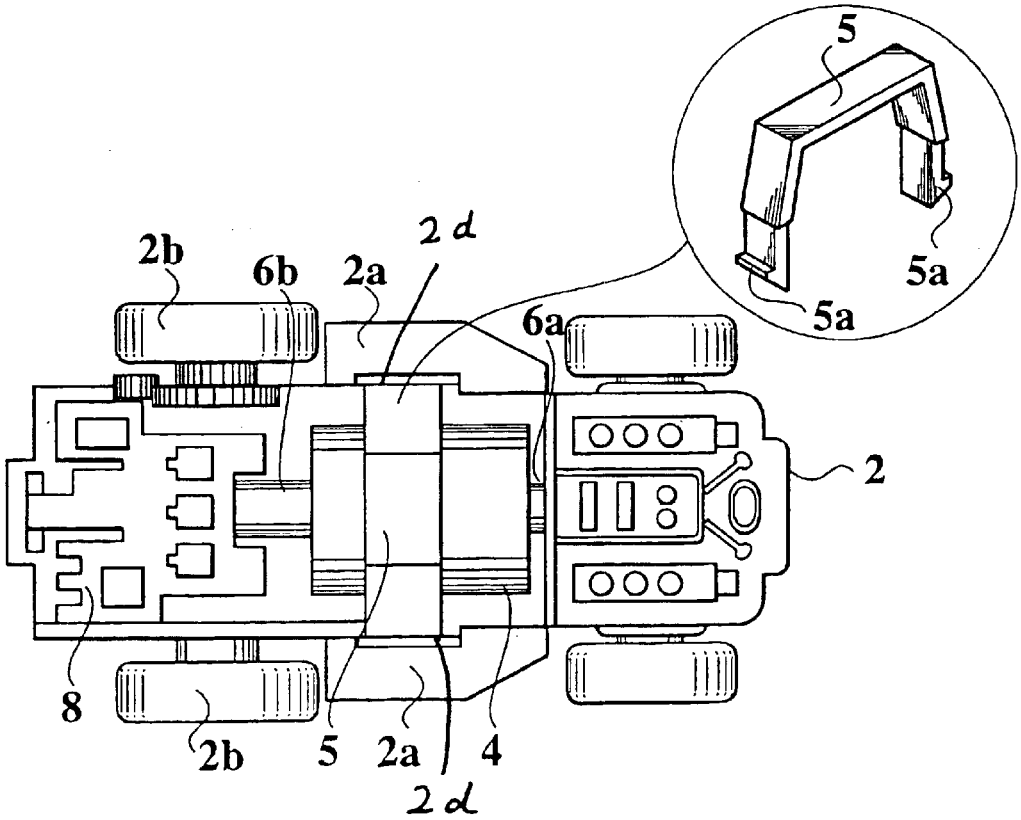
FIG. 2 is a plan view of a chassis of the racing vehicle toy of FIG. 1.

FIG. 1 is a perspective view of a racing vehicle (racing car) toy to which an attachment structure for motor according to the embodiment is applied. A housing of the vehicle toy 1 includes a chassis (base body) 2 and a body 3 as shown in FIG. 1 and FIG. 2. The chassis 2 and the body 3 are made of plastic or the like. A side portion of the body 3 has some elasticity. Each inside of the side portion has a recess portion (engage portion) which is elastically engaged with a projection portion 2*a* on opposite sides of the chassis 2, so that the body 3 is fixed with the chassis 2, which is not limited to such a structure. Preferably, a rear portion of the body 3 is provided with an opening 3*a* for improving the radiation effect of an after-mentioned motor 11.

FIG. 2 is a plan view of the chassis 2. A chargeable battery (for example, Ni—Cd battery) 4 is longitudinally set in a central portion of the chassis 2, however, it is not limited to that. This battery 4 is attached to a battery containing part (not shown) by an attachment member 5. This attachment member 5 is made of plastic or the like, and formed into an inverted U-shape so that the attachment member 5 can hold a body part of the battery 4. Both tree end portions of the attachment member 5 have at least elasticity and are capable of deforming in directions of coming close to and going away from each other. An outside of each free end portion is provided with an engaging pawl (engage portion) 5*a*. The engaging pawls 5*a* are hooked on edges (engage portions) of hole portions 2*d* of the chassis 2, so that the battery 4 can be fixed. The front and rear sides of the battery containing part are provided with conductive pieces 6*a* and 6*b* which can be electrically connected to a negative electrode and a positive electrode of the battery 4. The conductive pieces 6*a* and 6*b* are partially exposed to a bottom side of the chassis 2, which is not shown. The exposed conductive pieces 6*a* and 6*b* are used for charging the battery 4.

Figure 3:
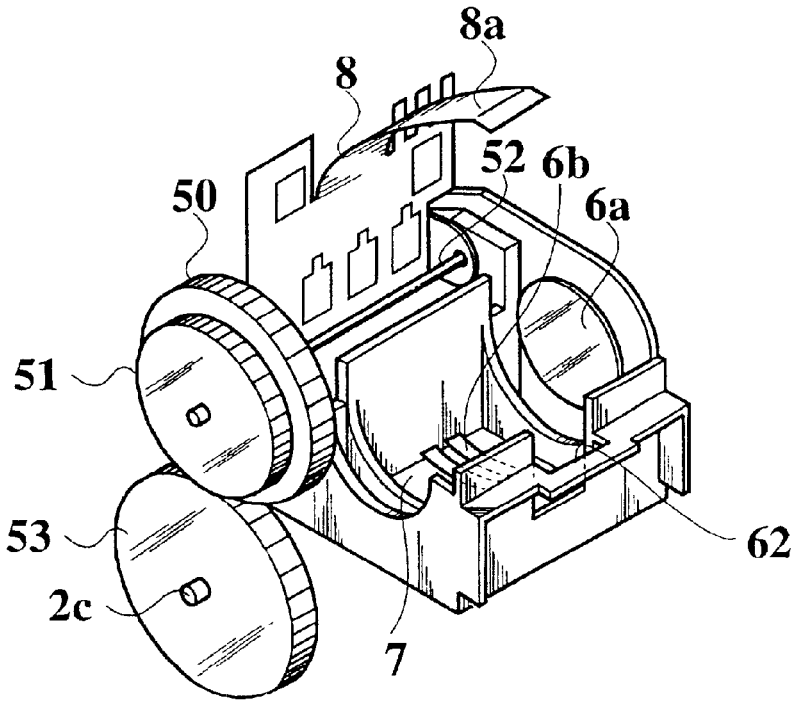
FIG. 3 is a perspective view of a motor containing part of the racing vehicle of FIG. 1.
Figure 4:
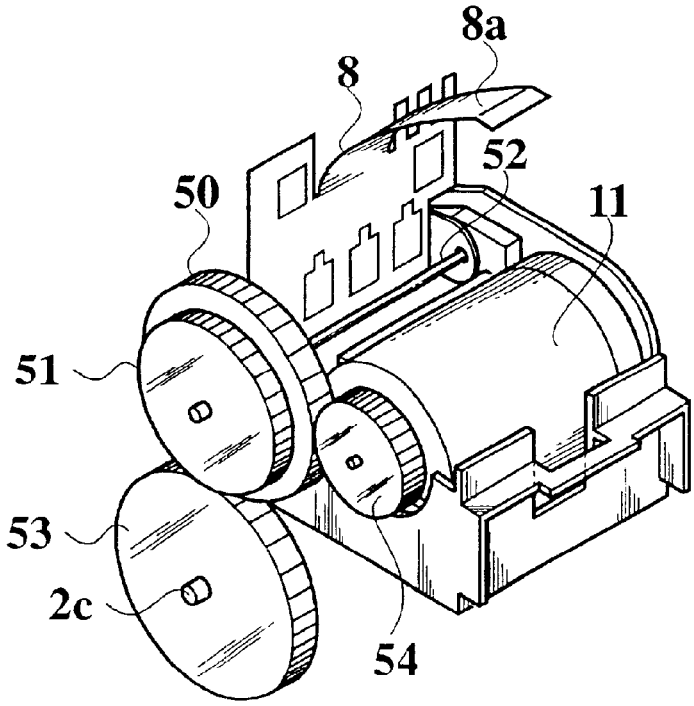
FIG. 4 is a perspective view of a motor containing part of the racing vehicle toy of FIG. 1.

A rear portion of the chassis 2 is provided with a motor containing part 7, as shown in FIG. 3. The motor 11 is transversely installed in the motor containing part 7, as shown in FIG. 4.

Figure 5:
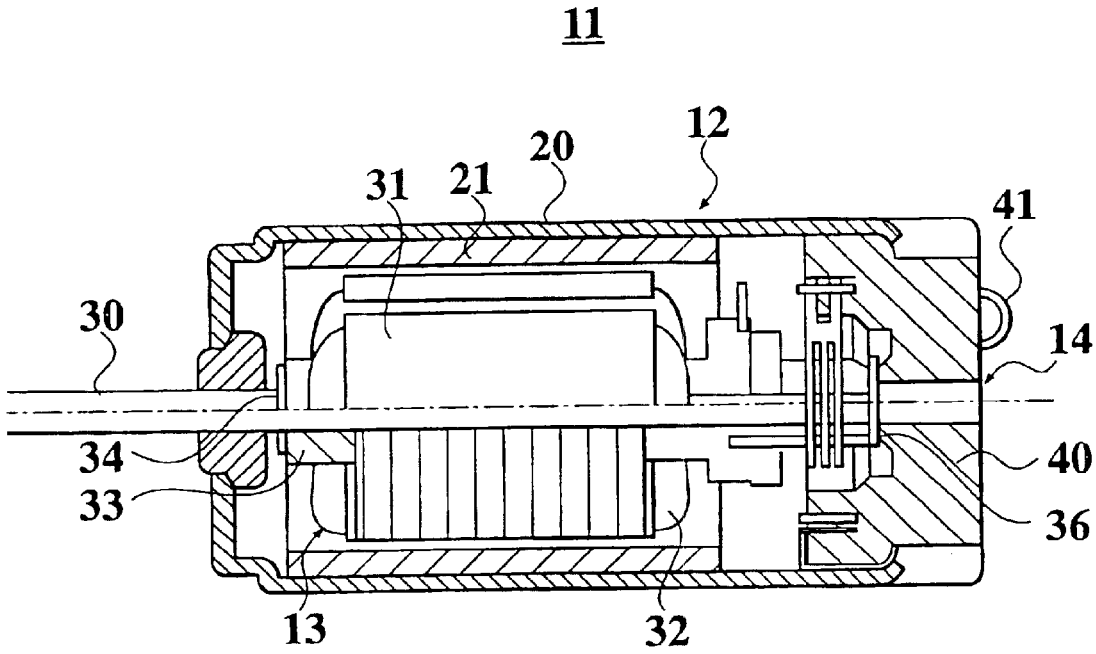
FIG. 5 is a cross sectional view of a motor employed for the racing vehicle toy of FIG. 1.

The motor 11 put in the motor containing part 7 is a DC motor and comprises a large case assembly 12, a completed rotor 13, and a small case assembly 14, as shown in FIG. 5. Hereinafter, the large case assembly 12, the completed rotor 13, and the small case assembly 14 will be explained in order, as follows.

Figure 6:
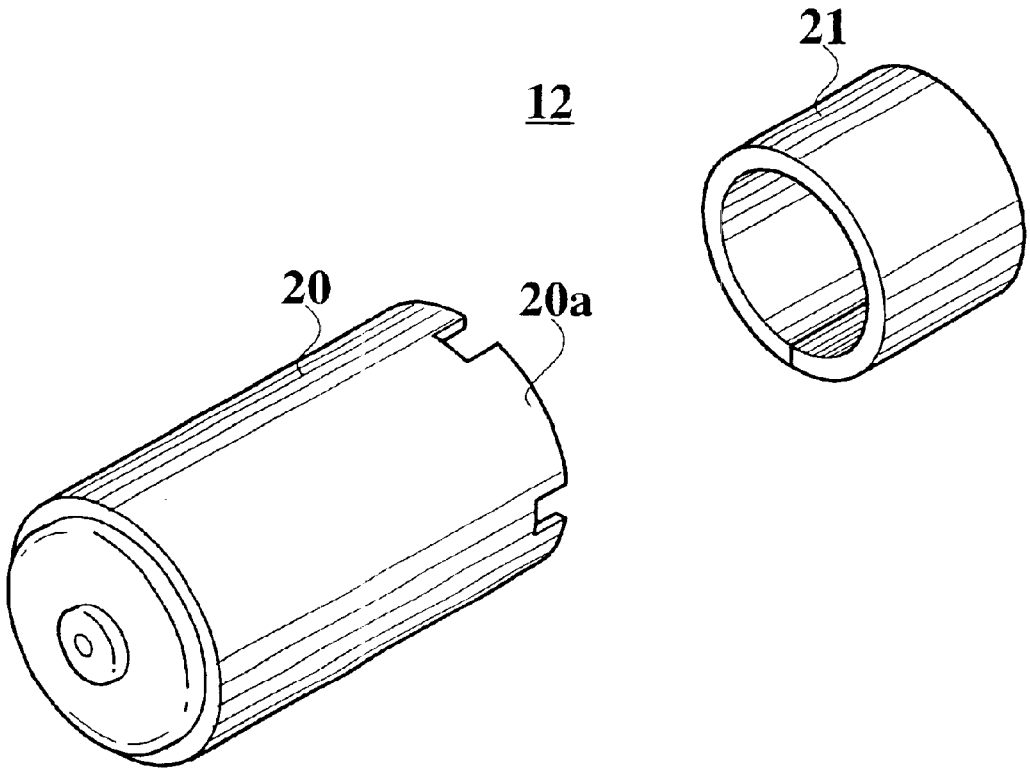
FIG. 6 is an exploded perspective view of a large case assembly of the motor of FIG. 5.

The large case assembly 12 comprises a large case (body part) 20 with an opening 20*a* which is formed at the rear side thereof, as shown in FIG. 6. The large case 20 is made of a conductive material.

With the large case assembly 12, a magnetic stator 21 is disposed in the large case 20. The stator 21 is generally made of a permanent magnet or an electro-magnet, to produce a constant magnetic field in the motor 11. In the embodiment, a permanent magnet is used as the stator 21.

Figure 7:
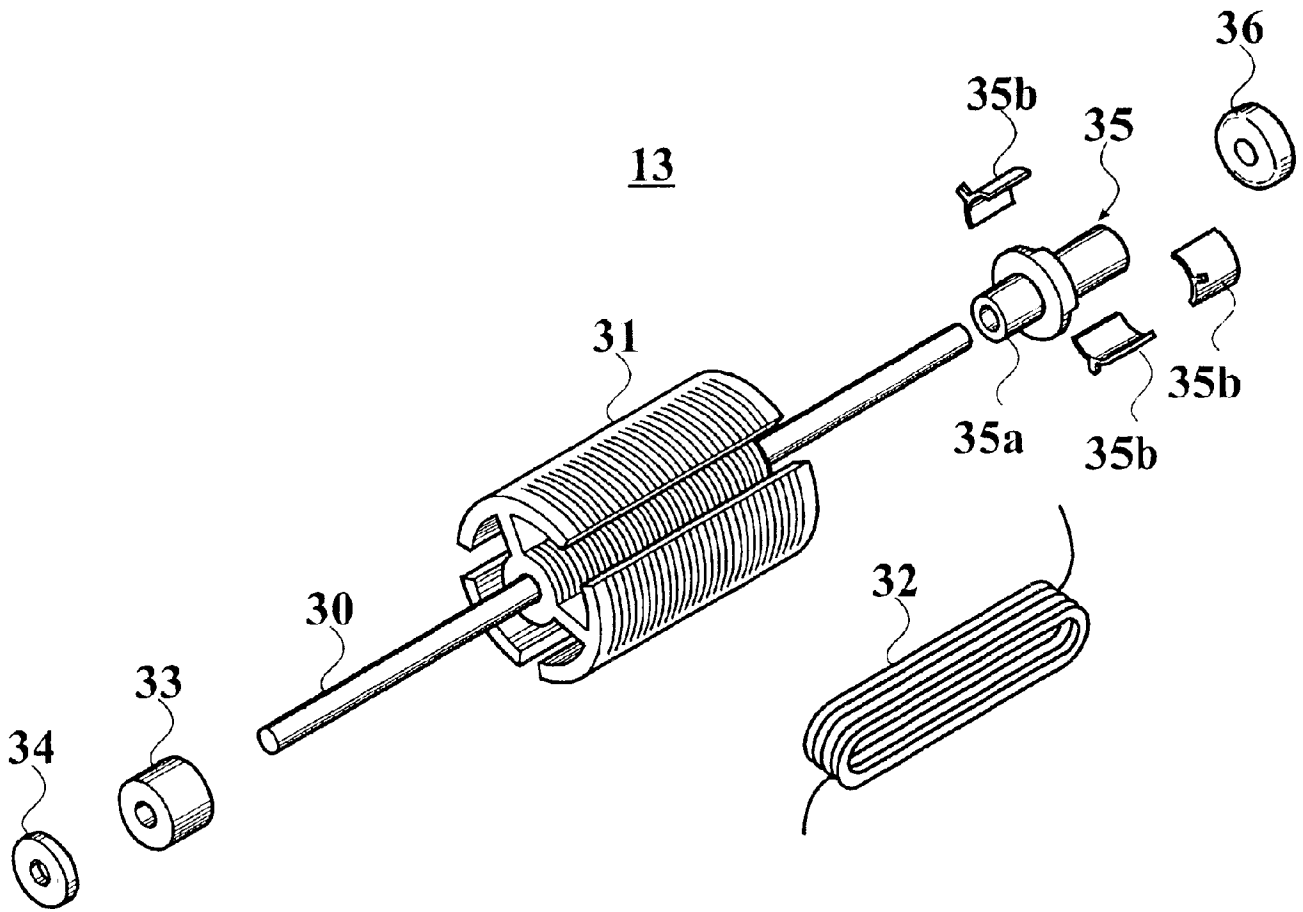
FIG. 7 is an exploded perspective view of a completed rotor of motor of FIG. 5.

The completed rotor 13 comprises a core 31 attached to a rotary shaft 30, a driving coil 32 wound around the core 31, a sleeve 33 and a thrust ring 34 which are disposed in an end side on the rotary shaft 30 for sandwiching the core 31, and a commutator 35 and oil cutter 36 which are disposed in the other end side on the rotary shaft 30, as shown in FIG. 7. The commutator 35 comprises a central member 35*a* and commutator pieces 35*b* which are attached to the central member 35*a*.

The small case assembly 14 comprises a small case 40 (FIG. 8) which is fitted in the large case 20 to cover the opening 20*a* of the large case 20. The small case 40 is made of an insulating material.

Figure 8:
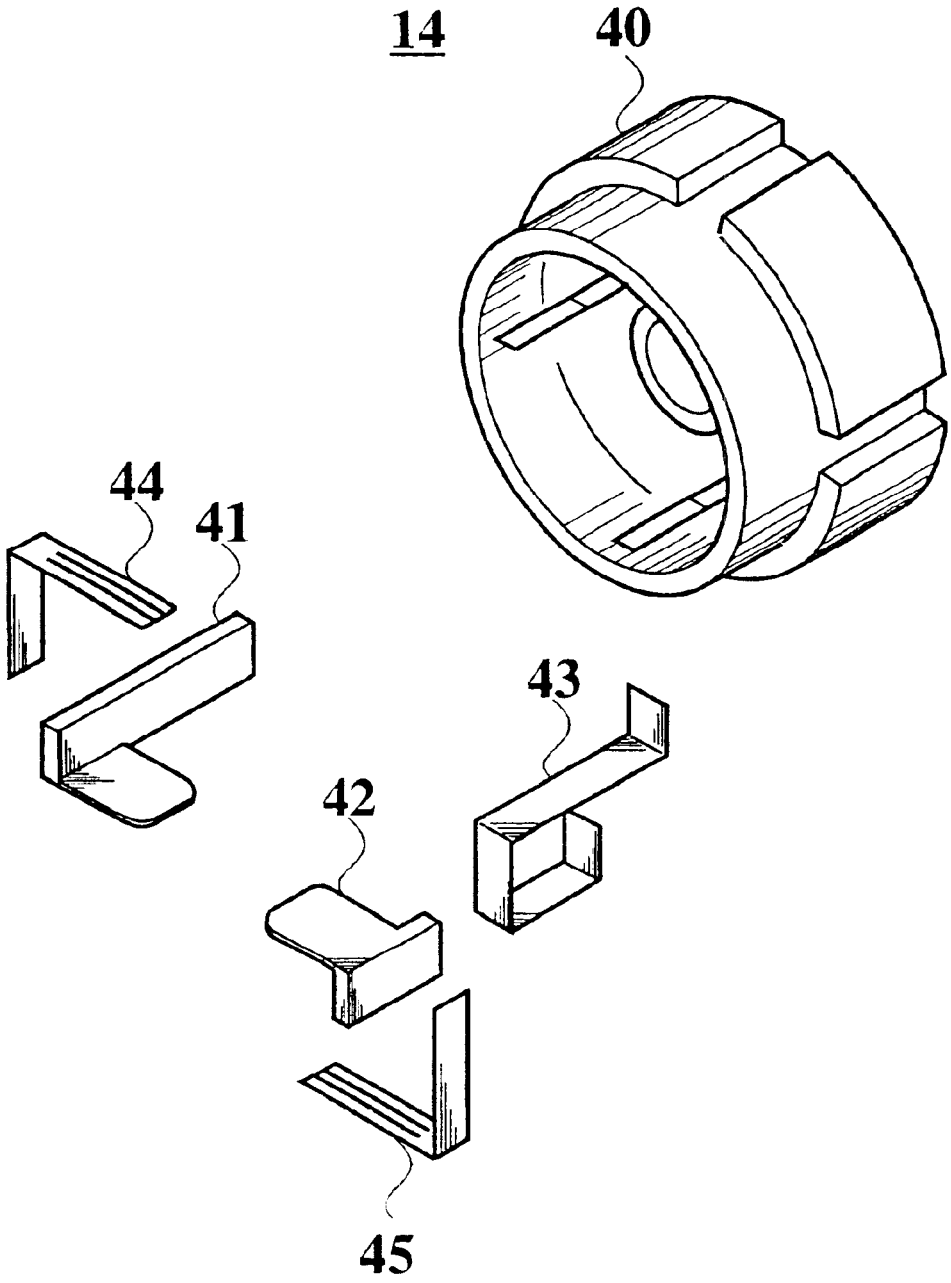
FIG. 8 is an exploded perspective view of a small case assembly of the motor of FIG. 5.

The small case assembly 14 further comprises conductive pieces 41, 42 and 43, and contact springs 44 and 45, which are attached to the small case 40, as shown in FIG. 8. An end of the conductive piece 41 is electrically connected to the negative electrode of the battery 4 to form a negative terminal. The other end of the conductive piece 41 has a structure to be able to electrically connect to the commutator 35 through the contact spring 44. The top end of the conductive piece 41 is bent after the conductive piece 41 was assembled to the small case 40, as shown in FIG. 5. The conductive piece 42 is connected to the large case 20 through the conductive piece 43. The large case 20 is electrically connected to the positive electrode of the battery 4. The conductive piece 42 has a structure to be able to electrically connect to the commutator 35 through the contact spring 45.

Next, the motor containing part 7 will be explained, but it is not limited to the following. One end of the conductive piece 6*a*, which is electrically connected to the negative electrode of the battery 4, extends to a right side wall of the motor containing part 7, as shown in FIG. 3. On the other hand, one end of the conductive piece 6*b*, which is electrically connected to the positive electrode of the battery 4, extends to the bottom of the motor containing part 7. When the motor 11 is installed in the motor containing part 7, as shown in FIG. 4, the negative terminal 41 at the rear side of the motor 11 is automatically, electrically connected to the conductive piece 6*a*, while the positive terminal 20 on the body part is automatically, electrically connected to the conductive piece 6*b*.

Gears 50 and 51 are provided in the vicinity of the left side wall of the motor containing part 7. The gears 50 and 51 are made of plastic or the like, and integrally formed such that the gears 50 and 51 idle about a transversal shaft (rotational shaft) 52. The gear 51 meshes with a gear 53 fixed to a wheel axle 2*c* of rear wheels 2*b* and 2*b*. Then, the rotation of the gear 53 by the motor power drives the rear wheels 2*b* and 2*b*. On the other hand, when the motor 11 is installed in the motor containing part 7, the gear 50 meshes with a gear 54 attached to a shaft of the motor 11.

Figure 9:
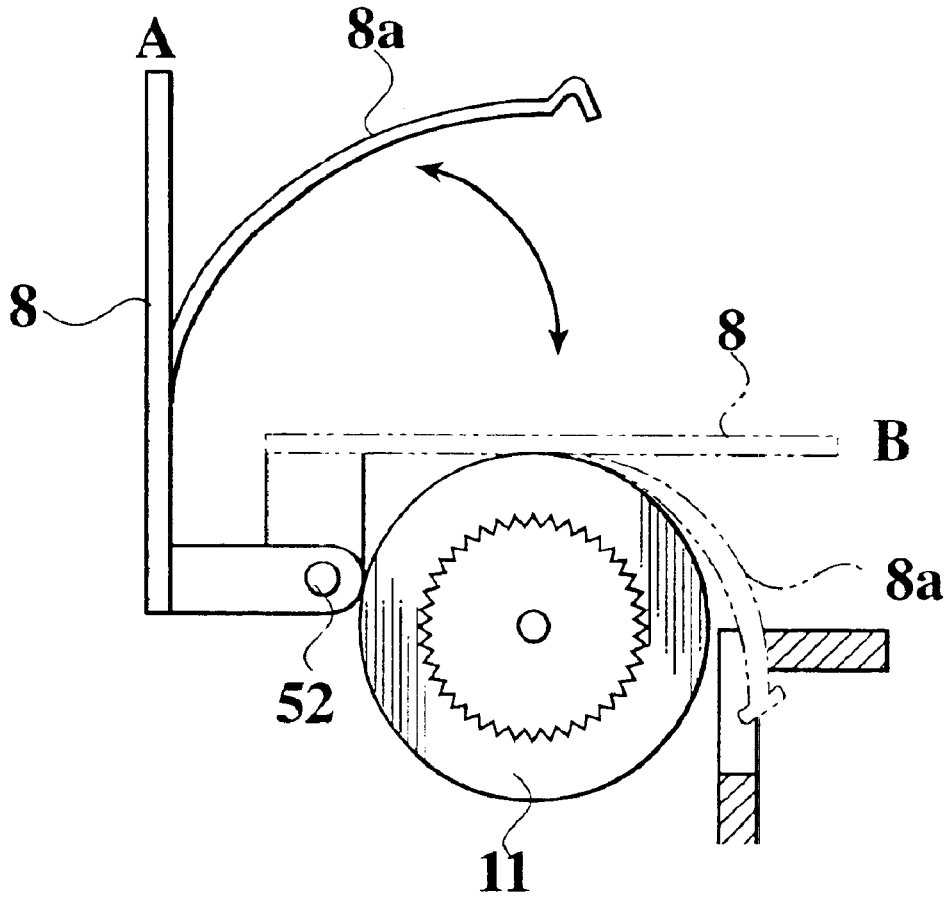
FIG. 9 is a side view showing opening and closing of a motor holding plate of the racing vehicle toy of FIG. 1.

Further, the rear portion of the chassis 2 is provided with a motor holding plate 8 or motor clip. The motor holding plate 8 is made of copper, which is not limited to that. Slits and holes are appropriately formed in the motor holding plate 8 to meet both the improvement of the radiation for the motor 11 and the efficiency of holding the motor 11. The motor holding plate 8 is capable of turning on the transversal shaft 52 extending in a lateral direction on the front side of the motor containing part 7. The motor holding plate 8 turns on the transversal shaft 52, so that the motor holding plate 8 can take up an open position (A of FIG. 9) for opening the motor containing part 7 and a close position (B of FIG. 9) for closing the motor containing part 7. At the close position, the motor holding plate 8 can hold the body part of the motor 11 set in the motor containing part 7.

A central portion on the free end of the motor holding plate 8 is curved, and the curved portion serves as an engaging portion or a hook portion 8*a*. The engaging portion 8*a* has elasticity. When the motor holding plate 8 turns on the transversal shaft 52 to move from the open position (A of FIG. 9) to the close position (B of FIG. 9), the engaging portion 8*a* is inserted into a hole portion 62 formed on the rear side of the motor containing part 7 of chassis 2. Then, the engaging portion 8*a* is engaged with an edge (engage portion) of the hole portion 62 by the elasticity of the engaging portion 8*a*.

The method for exchanging the motor 11 in the above-described attachment structure for motor will be explained.

At first, the body 3 is removed from the chassis 2. The motor holding plate 8 is turned on the transversal shaft 52, so that the motor holding plate 8 is moved to the open position (A of FIG. 9). In this state, the motor 11 is removed from the motor containing part 7. By this detachment, the electrical connections between the motor 11 and the conductive pieces 6*a* and 6*b* are released. The engagement between the gear 50 and the gear 54 attached to the shaft of the motor 11 is also released.

Next, another motor 11 is fitted in the motor containing part 7. By this installation, the negative terminal on the rear side of the motor 11 is electrically connected to the conductive piece 6*a*, while the positive terminal on the body part of the motor 11 is electrically connected to the conductive piece 6*b*. The gear 54 attached to the shaft of the motor 11 engages with the gear 50. Then, the motor holding plate 8 is turned on the transversal shaft 52 so as to move to the close position (B of FIG. 9). The engaging piece 8*a* is engaged with the edge (engage portion) of the hole portion 62. Thus, the motor 11 is fixed in the chassis 2. Thereafter, the body 3 is attached to the chassis 2.

It should also be understood that the present invention is not limited to the embodiment as the above described and various changes and modifications may be made to the invention without departing from the gist thereof.

For example, although the large case 20 makes a positive terminal in the above-described embodiments, the large case 20 may make a negative terminal. Two electrically separated regions formed on the large case 20 can also be adopted as positive and negative terminals. An exposed portion of an inner case which is provided in the large case 20 can also be adopted as a terminal. Although the large case 20 is used as a terminal in the above-described embodiments, it is possible to use the periphery of the small case 40 as the terminal instead of the large case 20.

As described above, according to the attachment structure for a motor for a toy of the present invention, the motor is easily set in and removed from the motor containing part by opening the motor holding plate, and easily fixed to the motor containing part by elastically engaging the engaging piece of the motor holding plate to the engage portion.

According to the racing vehicle (racing car) toy of the present invention, the user has only to turn the motor holding plate for exchanging the motor according to the racing course, handling is easy.

The entire disclosure of Japanese Patent Application No. Tokugan 2000-337726 filed on Nov. 6, 2000 including specification, claims, drawings and summary are incorporated herein by reference in its entirety.

What is claimed is:

1. An attachment structure of a motor of a toy, to set a motor in a motor containing part provided in a base body of the toy, the attachment structure comprising:

a motor holding plate to swing on a predetermined rotational shaft attached to the base body, the motor holding plate to take an open position to open the motor containing part and a closed position to close the motor containing part by the swing, the motor holding plate holding a body part of the motor set in the motor containing part at the closed position, and the motor holding plate comprising an engaging portion which engages an engage portion provided on the base body when the motor holding plate is disposed at the closed position, wherein the motor holding plate also serves as a radiation plate.

2. The attachment structure of the motor of the toy as claimed in claim 1, wherein the rotational shaft is parallel to a shaft of the motor set in the motor containing part, and the engage portion is provided on a position which is an opposite side of the motor containing part with respect to the rotational shaft line.

3. The attachment structure of the motor of the toy as claimed in claim 1 or claim 2, wherein the motor is a DC motor where terminals are provided on a rear side and on the body part, the motor containing part is provided with conductive pieces which are electrically connected to each of the terminals of the motor, and when the motor is fitted in the motor containing part, the corresponding conductive piece is electrically connected to each of the terminals.

4. The attachment structure of the motor of the toy as claimed in claim 1 or claim 2, wherein the motor is a DC motor where terminals are provided on a rear side and on the body part, the motor containing part is provided with a conductive piece which is electrically connected to the terminal on the rear side of the motor, the motor holding plate is made of conductive material so as to be electrically connected to the terminal on the body part of the motor, the conductive piece is electrically connected to the terminal on the rear side of the motor when the motor is fitted in the motor containing part, and when the motor holding plate is moved to the closed position while the motor is set in the motor containing part, the motor holding plate is electrically connected to the terminal on the body part of the motor.

5. The attachment structure of claim 1, wherein the motor holding plate comprises a material having a high radiation effect.

6. The attachment structure of claim 5, wherein the material is a metal.

7. The attachment structure of claim 6, wherein the metal comprises at least one of copper and aluminum.

8. The attachment structure of claim 1, wherein the motor holding plate has a form with a high radiation effect.

9. The attachment structure of claim 8, wherein the motor holding plate comprises at least one of a metal and a synthetic resin and further comprises an aperture formed therein, to have a high radiation effect.

10. The attachment structure of the motor of the toy of claim 1, wherein the engaging portion of the motor holding plate elastically engages the engage portion of the base body.

11. A toy comprising:

a base body provided with a battery containing part to contain a battery and a motor containing part to contain a cylindrical motor, and a motor holding member to swing on a shaft approximately parallel to a rotational shaft of the cylindrical motor, the motor holding member to take an open position to open the motor containing part and a closed position to close the motor containing part by the swing, and the motor holding member comprising an engaging portion to engage with an engage portion provided on the base body while the engaging portion holds an exposed peripheral portion of the motor set in the motor containing part at the closed position, wherein the motor holding plate also serves as a radiation plate.

12. The toy as claimed in claim 11, wherein the motor containing part of the base body is provided with a first electrode piece connected to one electrode of the battery at one position with which a peripheral body part of the motor is brought into contact and a second electrode piece connected to another electrode of the battery at a different position which is insulated to the one position, the motor is a DC motor, and at least a portion of the peripheral body part serves as one of positive and negative terminals of the motor.

13. The toy as claimed in claim 12, wherein a rear side of the motor is provided with the other of the positive and negative terminals of the motor, and the motor is contained in the motor containing part such that the peripheral body part is connected to the first electrode piece while the rear side is connected to the second electrode piece.

14. The toy of claim 11, wherein the motor holding plate comprises a material having a high radiation effect.

15. The toy of claim 14, wherein the material is a metal.

16. The toy of claim 15, wherein the metal comprises at least one of copper and aluminum.

17. The toy of claim 11, wherein the motor holding plate has a form with a high radiation effect.

18. The toy of claim 17, wherein the motor holding plate comprises at least one of a metal and a synthetic resin and further comprises an aperture formed therein, to have a high radiation effect.

19. The toy of claim 11, wherein the engaging portion of the motor holding plate elastically engages the engage portion of the base body.

20. A racing vehicle toy comprising:

an attachment structure of a motor of the toy, the attachment structure to set a motor in a motor containing part provided in a base body of the toy, the attachment structure comprising a motor holding plate to swing on a predetermined rotational shaft attached to the base body, wherein the motor holding plate takes an open position to open the motor containing part and a closed position to close the motor containing part by the swing, the motor holding plate holds a body part of the motor set in the motor containing part at the closed position, and the motor holding plate comprises an engaging portion to engage an engage portion provided on the base body when the motor holding plate is disposed at the closed position, and wherein the motor holding plate also serves as a radiation plate.

21. The racing vehicle toy as claimed in claim 20, wherein the rotational shaft in the attachment structure of the motor of the toy is parallel to a shaft of the motor set in the motor containing part, and the engage portion is provided on a position which is an opposite side of the motor containing part with respect to the rotational shaft line.

22. The racing vehicle toy as claimed in claim 20, wherein the motor is a DC motor where terminals are provided on a rear side and a body part, the motor containing part is provided with conductive pieces which are electrically connected to each of the terminals of the motor, and when the motor is fitted in the motor containing part, the corresponding conductive piece is electrically connected to each of the terminals.

23. The racing vehicle toy as claimed in claim 20, wherein the motor is a DC motor where terminals are provided on a rear side and a body part, the motor containing part is provided with a conductive piece which is electrically connected to the terminal on the rear side of the motor, the motor holding plate is made of conductive material to be electrically connected to the terminal on the body part of the motor, the conductive piece is electrically connected to the terminal on the rear side of the motor when the motor is fitted in the motor containing part, and when the motor holding plate is moved to the closed position while the motor is set in the motor containing part, the motor holding plate is electrically connected to the terminal on the body part of the motor.

24. The racing vehicle toy of claim 20, wherein the motor holding plate comprises a material having a high radiation effect.

25. The racing vehicle toy of claim 24, wherein the material is a metal.

26. The racing vehicle toy of claim 25, wherein the metal comprises at least one of copper and aluminum.

27. The racing vehicle toy of claim 20, wherein the motor holding plate has a form with a high radiation effect.

28. The racing vehicle toy of claim 27, wherein the motor holding plate comprises at least one of a metal and a synthetic resin and further comprises an aperture formed therein, to have a high radiation effect.

29. The racing vehicle toy of claim 20, wherein the engaging portion of the motor holding plate elastically engages the engage portion of the base body.

* * * * *